US009915509B2

(12) United States Patent
Chung

(10) Patent No.: US 9,915,509 B2
(45) Date of Patent: Mar. 13, 2018

(54) CLAYMORE MINE ON WHICH DEVICE FOR PREVENTING BREAKDOWN ATTRIBUTABLE TO POWER NOISE HAS BEEN MOUNTED

(71) Applicant: Young-Ki Chung, Seoul (KR)

(72) Inventor: Young-Ki Chung, Seoul (KR)

( * ) Notice: Subject to any disclaimer, the term of this patent is extended or adjusted under 35 U.S.C. 154(b) by 299 days.

(21) Appl. No.: 14/801,188

(22) Filed: Jul. 16, 2015

(65) Prior Publication Data

US 2016/0047640 A1 Feb. 18, 2016

(30) Foreign Application Priority Data

Aug. 18, 2014 (KR) ..... 10-2014-0107058

(51) Int. Cl.

| | |
|---|---|
| ***F42B 3/18*** | (2006.01) |
| ***F42B 3/185*** | (2006.01) |
| ***F42B 23/10*** | (2006.01) |
| ***F42C 11/00*** | (2006.01) |

(52) U.S. Cl.
CPC ..... *F42B 3/185* (2013.01); *F42B 23/10* (2013.01); *F42C 11/007* (2013.01)

(58) Field of Classification Search
USPC ..... 102/202.1, 202.2, 427
See application file for complete search history.

(56) References Cited

U.S. PATENT DOCUMENTS

| | | | | |
|---|---|---|---|---|
| 3,370,140 A * | 2/1968 | Betts | H01R 13/6581 | 102/202.2 |
| 4,677,518 A * | 6/1987 | Hershfield | H02H 9/06 | 361/118 |
| 4,822,950 A * | 4/1989 | Schmitt | H01B 11/1813 | 174/109 |

FOREIGN PATENT DOCUMENTS

| | | |
|---|---|---|
| JP | 3121073 | 4/2006 |
| KR | 19940008834 | 9/1994 |
| KR | 200452132 | 2/2011 |
| KR | 1020120080924 | 7/2012 |
| KR | 101171391 | 8/2012 |

* cited by examiner

*Primary Examiner* — Reginald S Tillman, Jr.
(74) *Attorney, Agent, or Firm* — Hamre, Schumann, Mueller & Larson, P.C.

(57) ABSTRACT

Disclosed is a claymore mine on which a device for preventing a breakdown attributable to a power noise has been mounted. In order to prevent an electric primer from operating due to a power noise induced by a magnetic field or generated by the falling of a thunderbolt or other factors, such as a communication device, a shield layer formed by weaving or braiding a conductive fiber, such as a carbon fiber, or weaving or braiding a copper-plated tin wire, is formed in the wire and percussion unit of the claymore mine. In order to discharge a power noise introduced into the wire and the percussion unit to the earth, a power noise discharge adaptor including a plurality of diodes, a TVS, a GDT, and an SPD is formed. Accordingly, the introduction of a power noise can be fundamentally blocked, and a power noise can be safely discharged to the earth if the power noise is introduced.

6 Claims, 4 Drawing Sheets

CLAYMORE MINE ON WHICH DEVICE FOR PREVENTING BREAKDOWN ATTRIBUTABLE TO POWER NOISE HAS BEEN MOUNTED

CROSS REFERENCE TO RELATED APPLICATION

The present application claims the benefit of Korean Patent Application No. 10-2014-0107058 filed in the Korean Intellectual Property Office on Aug. 18, 2014, the entire contents of which are incorporated herein by reference.

BACKGROUND OF THE INVENTION

1. Technical Field

The present invention relates to a claymore mine on which a device for preventing a breakdown attributable to the falling of a thunderbolt has been mounted and, more particularly, to a claymore mine in which a percussion unit does not operate although the falling of a thunderbolt, an earth fault current, an electromagnetic pulse (EMP), a nuclear electromagnetic pulse (NEMP), a high altitude nuclear electromagnetic pulse (HEMP), or magnetic fields, electromagnetic waves, or other electromagnetic wave noises generated in other various forms are introduced into a wire connecting the electric primer of the claymore mine and a percussion unit or the percussion unit.

2. Description of the Related Art

An M18 A1 claymore mine is a type of anti-personal mine developed in U.S. in 1960s. A claymore mine is an anti-personal mine developed in various models based on the M18 A1 claymore mine and used for military purposes. An anti-personal mine has various forms depending on an operation mechanism, such as an explosion method. In an embodiment of the present invention, an M18 A1 claymore mine (hereinafter referred to as a claymore mine), that is, an anti-personal mine in which an electrical current generated by an electrical percussion unit is transferred to an electric primer through a wire (or cable), the electric primer explodes by the electrical current supplied by the percussion unit, and a loaded explosive explodes by the explosion of the electric primer, is described as an example. It is however to be noted that an embodiment of the present invention is not limited to the M18 A1 claymore mine, but may be applied to all mines driven by such an operation mechanism.

In general, a claymore mine includes a percussion unit 5, a wire 4, and a main body. The main body includes an electric primer 3 and an explosion unit 2 into which a C4 explosive has been loaded.

In accordance with the mechanism of such a claymore mine, when the percussion unit 5 operates, an electrical current of 1 A or more is supplied to the electric primer 3 through the wire 4 of 30 m~50 m in length. The electric primer 3 explodes in response to the electrical current, and the C4 explosive explodes by the explosion of the electric primer 3. Accordingly, several hundreds of ball bearings are fired to the front.

In such a structure, if a voltage attributable to a magnetic field or an impulse noise is introduced into the wire or the percussion unit 5 due to an external factor, the claymore mine may explode contrary to a user's intention.

In particular, the operating circuit of the percussion unit 5 is illustrated in FIG. 2. In such a circuit, when a voltage of 0.6 V or more is applied to the wire 4 or a circuit pattern within the percussion unit 5, an electrical current is momentarily transferred to the electric primer 3 through the wire 4.

The operating circuit of the percussion unit 5 has been adopted in the M18 A1 claymore mine scores of years ago and has been known in the Army Headquarters Combat Infantry Troop Business Reference (Apr. 30, 1979) and Patent Document 2 to be described later, and a description of the operation thereof is omitted.

In particular, in areas where the falling of a thunderbolt is frequently generated, an accident in which a claymore mine operates by an induced voltage attributable to the falling of a thunderbolt frequently occurs.

In order to prevent the breakdown of a claymore mine attributable to such an unwanted nonessential and non-urgent induced voltage electrical current, Korean Patent No. 10-1171391 has suggested a claymore mine for preventing an explosion attributable to the falling of a thunderbolt surge, which prevents the operation of an electric primer by controlling the falling of a thunderbolt surge using a switch for disconnecting the positive pole and negative pole of the electric primer in the state in which the positive pole and negative pole of the electric primer have been disconnected.

However, this patent is problematic in that a switch manipulation unit needs to be driven in order to remove a surge voltage toward the wire or the percussion unit and the operation of the claymore mine needs to be returned to its original position by manipulating the switch in order for the claymore mine to actually operate. Furthermore, there is a problem in that when the claymore mine is in an idle state for an operation, a voltage induced by a nonessential and non-urgent brain impulse introduced into the wire or the percussion unit or the introduction of a magnetic field is intruded into the percussion unit without a change.

Furthermore, Korean Patent Publication No. 1994-0008834 suggests a basis circuit operation and structure, including an electronic percussion system for a claymore mine, that is, an electronic percussion type anti-personal mine, an electric primer (EF) for the electronic percussion system, a wire detonator diagnosis unit for diagnosing and displaying a wire disconnection, and a check display light.

However, this patent does not suggest a preparation indicating that a voltage of a specific amount or higher is introduced into the wire and the percussion unit due to a magnetic field or is introduced into the wire and the percussion unit due to an external factor.

Furthermore, this patent never suggests a protection device for preventing the introduction of a magnetic field or an electrical noise attributable to an external factor into the wire and percussion unit of the claymore mine.

Furthermore, if a separate electronic part is inserted between the basic elements of the claymore mine, that is, the percussion unit, the wire, and the electric primer, the breakdown of the electronic part leads to a reduction of fighting power and a fatal failure factor in alert order. Accordingly, an added part needs to be easily removed if necessary. In other words, military goods need to have emergency operation structures so that some of the military goods can be bypassed, if necessary. However, the prior art document does not disclose such a preparation.

PRIOR ART DOCUMENT

Patent Document (Patent Document 1) Korean Patent No. 10-1171391 (Jul. 31, 2012)

(Patent Document 2) Korean Patent Publication No. 1994-0008834 (Sep. 26, 1994)

SUMMARY OF THE INVENTION

Accordingly, the present invention has been made keeping in mind the above problems occurring in the prior art, and an object of the present invention is to provide a claymore mine on which a device for preventing a breakdown attributable to a power noise has been mounted, wherein a shield layer formed by weaving or braiding conductive fiber, such as a carbon fiber, or by weaving or braiding a copper-plated tin wire so that an electric primer does not operate due to a voltage (hereinafter referred to as a power noise, for convenience of description) that may be introduced due to the falling of a thunderbolt or other factors, such as a communication device, is formed and an adaptor configured to discharge an introduced power noise and to include a plurality of diodes, a transient voltage suppressor (TVS), a gas discharge tube (GDT), and a surge protection device (SPD) so that a power noise introduced into a wire and a percussion unit can be discharged to the earth is formed, thereby being capable of fundamentally blocking the introduction of a power noise and safely discharging an introduced power noise to the earth.

Another object of the present invention is to provide a claymore mine on which a device for preventing a breakdown attributable to a power noise has been mounted, wherein the electrical connection terminal of the discharge adaptor is connected to the output terminal of the percussion unit using an outlet-plug coupling method and the other side of the discharge adaptor and the wire are also connected using an outlet-plug coupling method in preparation for the breakdown of the discharge adaptor.

In an embodiment of the present invention, the outlet-plug coupling method means a method of coupling and separating an outlet and a plug, wherein a coupling and separation form is known in the field to which the present invention pertains, as disclosed in Korean Utility Model No. 0452132, although the shape and structure of a coupled coupling unit may be different.

Furthermore, an object of the present invention is to provide a claymore mine on which a device for preventing a breakdown attributable to a power noise has been mounted, wherein when the discharge adaptor breaks down, the wire and the percussion unit can be coupled using the outlet-plug coupling method after the discharge adaptor is separated and removed.

In accordance with an embodiment of the present invention, a claymore mine on which a device for preventing a breakdown attributable to a power noise has been mounted includes an electric primer 20 connected to an explosion unit 10, a percussion unit 30 configured to include a switch for supplying or blocking a power source and electricity, that is, the power supply circuit of FIG. 2 known in the field to which the present invention pertains, and a circuit for amplifying received power and to supply the electric primer 20 with power through a wire 40, that is, an insulated conductive wire, and a discharge adaptor 50 configured to have one end electrically connected to one end of the wire 40 and to have the other end electrically connected to the percussion unit 30.

The wire 40 includes a shield layer 41 formed by weaving or braiding a conductive carbon fiber, by weaving or braiding a metal line, or by dispersing carbon to synthetic resin and applying conductivity to the synthetic resin so that electromagnetic waves can be shielded, two threads of insulating wires formed of conductor insulation layers 43 placed within the shield layer 41 and configured to insulate respective conductors 44, and an insulation layer 42 configured to cover the outside of the shield layer 41.

Furthermore, the discharge adaptor 50 includes a surge protection circuit unit 55 in which a plurality of diodes, a transient voltage suppressor (TVS), a gas discharge tube (GDT), and a surge protection device (SPD) are electrically connected in order to discharge an introduced power noise. The surge protection circuit unit 55 includes a discharge adaptor shield layer 51 made of the same material as the shield layer 41 of the wire 40. The discharge adaptor shield layer 51 has been molded using synthetic resin. A discharge adaptor outlet 52 and the discharge adaptor plugs 53 which may be electrically connected to or separated from the wire 40 and the percussion unit 30 are integrally formed outside the molding unit.

DETAILED DESCRIPTION

Some exemplary embodiments of the present invention are described in detail with reference to the accompanying drawings.

Figure 3:
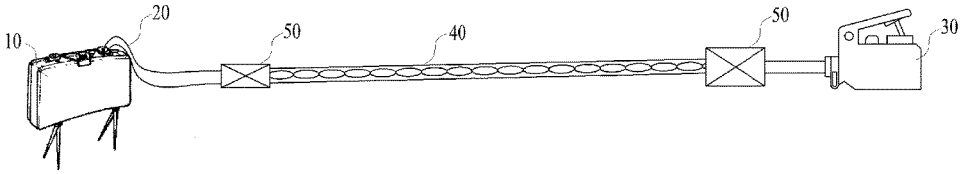
FIG. 3 is a diagram illustrating that a claymore mine including a discharge adaptor and a shielded wire have been connected in accordance with an embodiment of the present invention.

FIG. 3 is a diagram illustrating that a claymore mine including a discharge adaptor and a shielded wire have been connected in accordance with an embodiment of the present invention.

Figure 1:
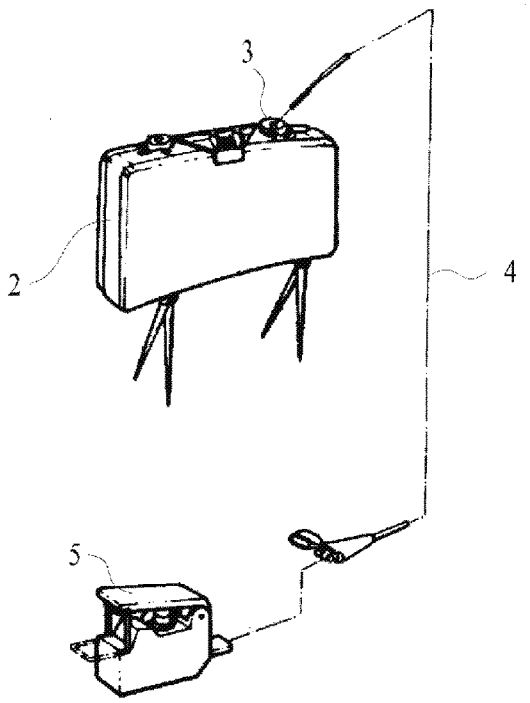
Fig. 1 (Prior Art)
FIG. 1 is a diagram illustrating that a conventional claymore mine has been installed.
Figure 2:
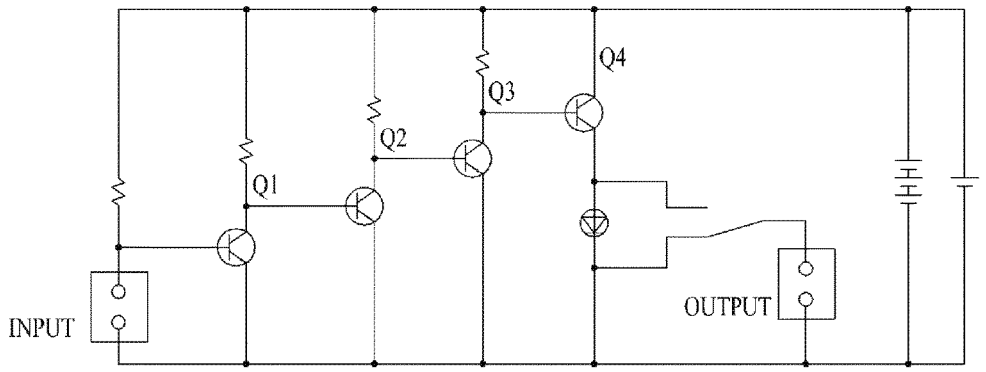
Fig. 2 (Prior Art)
FIG. 2 is an internal circuit diagram of a known percussion unit commonly used in the field to which the present invention pertains.

As illustrated in FIG. 3, the claymore mine on which a device for preventing a breakdown attributable to a power noise has been mounted in accordance with an embodiment of the present invention includes an electric primer 20 connected to an explosion unit 10, a percussion unit 30 configured to include a switch for supplying or blocking a power source and electricity, that is, the power supply circuit of FIG. 2 known in the field to which the present invention pertains, and a circuit for amplifying received power and to supply the electric primer 20 with power through a wire 40, that is, an insulated conductive wire, and a discharge adaptor 50 configured to have one end electrically connected to one end of the wire 40 and to have the other end electrically connected to the percussion unit 30.

Figure 5:
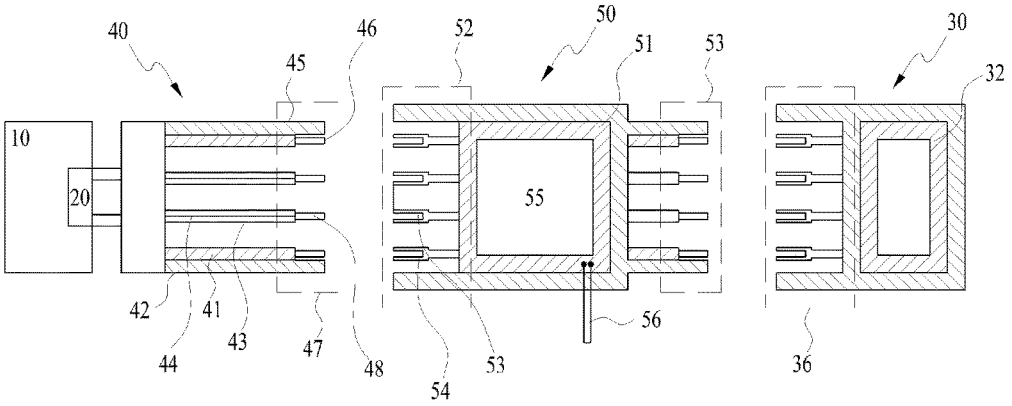
FIG. 5 is a detailed diagram illustrating a structure in which wires, the discharge adaptor, and a percussion unit have been connected in accordance with an embodiment of the present invention.
Figure 6:
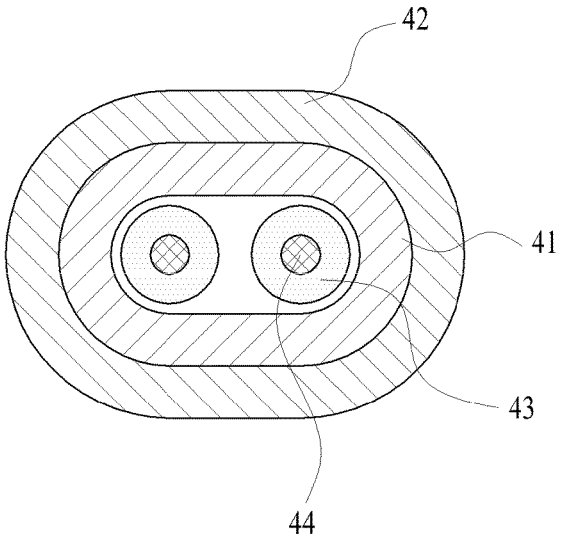
FIG. 6 is a cross-sectional view of the wires in accordance with an embodiment of the present invention.

As illustrated in FIGS. 5 and 6, the wire 40 includes a shield layer 41 formed by weaving or braiding a conductive carbon fiber, by weaving or braiding a metal line, or by dispersing carbon to synthetic resin and applying conductivity to the synthetic resin so that electromagnetic waves can be shielded, two threads of insulating wires formed of conductor insulation layers 43 placed within the shield layer 41 and configured to insulate respective conductors 44, and an insulation layer 42 configured to cover the outside of the shield layer 41. In an embodiment of the present invention, configuring the shield layer 41 means that the wire has been shielded.

The wire 40 functions to shield an external magnetic field or a magnetic field induced by electromagnetic waves because it is a braided conductor. Furthermore, the wire 40 is electrostatically shielded, and functions to shield electromagnetic waves.

Figure 7:
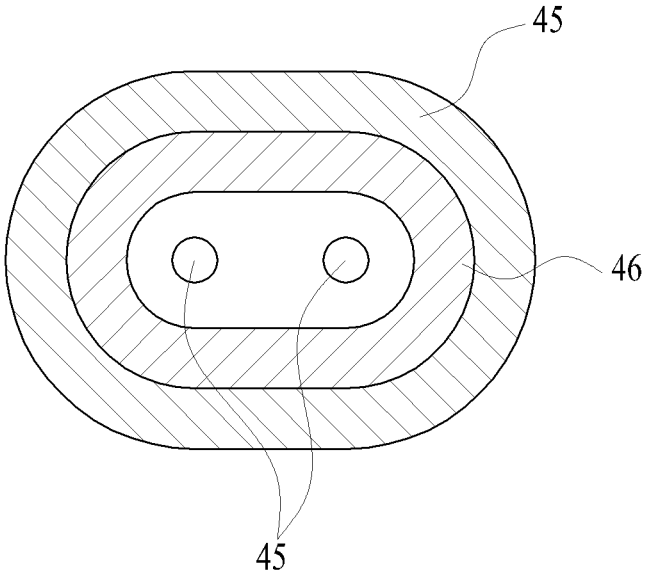
FIG. 7 a cross-sectional view of a plug in accordance with an embodiment of the present invention.

Furthermore, one end of the wire 40 connected to the discharge adaptor outlet 52 of the discharge adaptor 40 has been processed in a molded plug-outlet form that is known to the field to which the present invention pertains. The shape of one end of the wire 40 may be a quadrangle or circle. As illustrated in FIG. 7, the wire 40 includes two plug pins 48 respectively connected to the two conductors 44 and disposed at the central part of the wire at a specific insulation distance, wire plug shield layer connection plugs 46 spaced apart from the plug pins 48 at a specific interval, electrically connected to the shield layer 41, and configured to have a cylindrical shape, and a wire plug 47 configured include a wire plug outwall 45 configured to support the plug pins 48 and the wire plug shield layer connection plugs 46 and connected to the insulation layer 43 of the wire 40.

The wire plug 47 has the same configuration as the discharge adaptor plug 53 of the discharge adaptor 50 except a connection target to which the plug pins and the plug shield layer connection unit are connected.

In an embodiment of the present invention, an example in which the discharge adaptor 50 is connected between the wire 40 and the percussion unit 30 is chiefly described. In some embodiments, the discharge adaptor 50 may be additionally installed between the electric primer 20 and the wire 40. If the discharge adaptor 50 is additionally installed between the electric primer 20 and the wire 40, a wire plug 47 provided on the other side of the wire 40 is the same as that described above.

Furthermore, the discharge adaptor 50 is a surge protection circuit unit 55 in which a plurality of diodes known in the field to which the present invention pertains, a transient voltage suppressor (TVS) known in the field to which the present invention pertains, a gas discharge tube (GDT) known in the field to which the present invention pertains, and a surge protection device (SPD) known in the field to which the present invention pertains are electrically connected in order to discharge an introduced power noise. The surge protection circuit unit 55 includes a discharge adaptor shield layer 51 made of the same material as the shield layer 41 of the wire 40. The discharge adaptor shield layer 51 has been molded using synthetic resin. A discharge adaptor outlet 52 and the discharge adaptor plugs 53 which may be electrically connected to or separated from the wire 40 and the percussion unit 30 are integrally formed outside the molding unit.

The discharge adaptor outlet 52 of the discharge adaptor 50 has been configured to have the wire plug 47 inserted and connected thereto, and a detailed description thereof is omitted. In this case, the two discharge adaptor plugs 53 of the discharge adaptor outlet 52 are respectively connected to the (+) output terminal and (−) output terminal of the surge protection circuit unit 55 (in this case, the side connected to the wire 40 is called the output terminal, and the side connected to the percussion unit 30 is called an input terminal) and are connected to the wire plug 47. Furthermore, shield layer plug trays 54 are connected to the wire plug shield layer connection plugs 46, and the other sides of the shield layer plug trays 54 are connected to the discharge adaptor shield layer 51 of the surge protection circuit unit 55.

The discharge adaptor plugs 53 connected to the percussion unit outlet 31 of the percussion unit 30 have the same configuration as the wire plug 47 as described above. In this case, the plug pins of the wire plug 47 are respectively connected to the (+) output terminal and (−) output terminal of the surge protection circuit unit 55, and the shield layer connection plugs 46 are connected to the discharge adaptor shield layer 51.

The percussion unit outlet 36 of the percussion unit 30 has the same configuration as the discharge adaptor outlet 52. In some embodiment, the percussion unit outlet 36 may be directly connected to the wire plug 47. The percussion unit outlet 36 is different from the discharge adaptor outlet 52 in that the plug trays are connected to the output terminal of the circuit diagram of the percussion unit of FIG. 2 and the shield layer plug trays are connected to a percussion unit shield layer 32. Accordingly, a detailed description of the percussion unit outlet 36 is omitted. In an embodiment of the present invention, the percussion unit shield layer 32 has been illustrated as being included. In some embodiments, the percussion unit 30 may not be shielded.

Furthermore, a ground line 56 penetrating the molding unit is connected to the discharge adaptor shield layer 51. The ground line 56 is connected to the earth through a ground body or ground pin (not illustrated).

Figure 4:
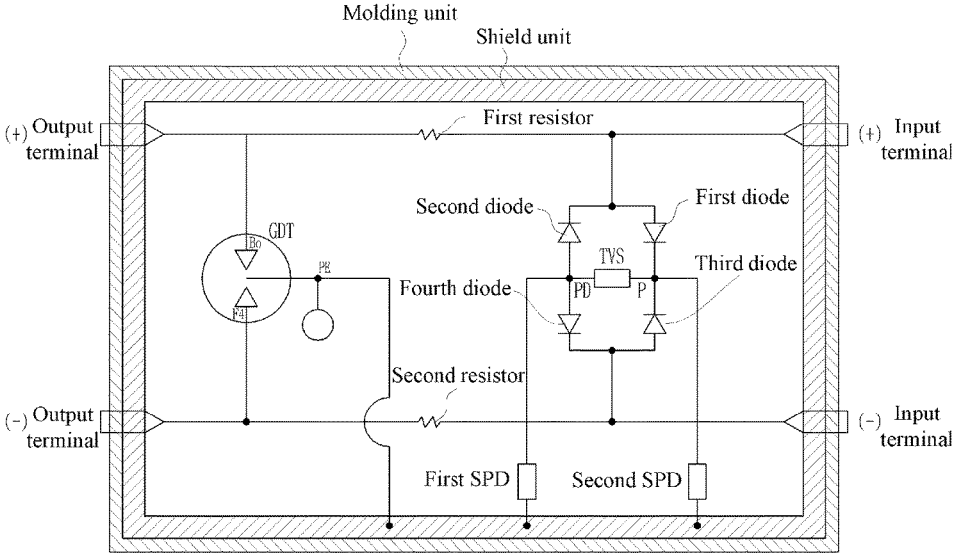
FIG. 4 is an internal circuit diagram of the discharge adaptor in accordance with an embodiment of the present invention.

The surge protection circuit unit 55 shielded and molded in the discharge adaptor 50 is described below with reference to FIG. 4.

The output terminal of the circuit diagram of the percussion unit of FIG. 2 is electrically connected to the (+) input terminal and (−) input terminal of the surge protection circuit unit 55 through the percussion unit outlet 36 and the discharge adaptor plugs 53. The (+) input terminal of the percussion unit of FIG. 2 is connected to the cathode of a second diode and the anode of a first diode, connected to the terminal Bo of the GDT through a first resistor, and also electrically connected to the conductor of the wire 40 through the (+) output terminal of the surge protection circuit unit 55.

Furthermore, the anode of the second diode is connected to the terminal PD of the TVS and the anode of a fourth diode, also connected to the discharge adaptor shield unit 51 connected to the ground line through a first SPD, and then grounded. The cathode diode of the first diode is connected to the terminal P of the TVS and the cathode of a third diode, connected to the discharge adaptor shield 51 connected to the ground line through the second SPD, and then grounded.

Furthermore, in the circuit diagram of the percussion unit of FIG. 2, the other terminal of the output terminals is connected to the anode of the third diode and the cathode of the fourth diode, connected to the terminal F4 of the GDT through a second resistor, and electrically connected to the other conductor of the wire 40 through the (−) output terminal of the surge protection circuit unit 55. Furthermore, the PE terminal of the GDT is connected to the discharge adaptor shield unit 51.

The operation of the surge protection circuit unit 55 configured as described above is described below.

First, the normal operating state of the surge protection circuit unit 55 is described.

When the percussion unit of FIG. 2 normally operates, transistors Q1, Q2, Q3, and Q4 sequentially operate, and thus an electrical current of 1 A or more is generated. The generated electrical current does not conduct to the first to fourth diodes connected to the input terminal of the discharge adaptor 50 due to a diode that belongs to the first to fourth diodes and that is inversely connected. The generated electrical current has an SPD operating voltage or less. In the GDT operating voltage or less, an electrical current introduced into the input terminal of the discharge adaptor 50 is supplied to the electric primer 20 through the wire 40 without a change. Accordingly, the claymore mine normally operates.

An operation of the surge protection circuit unit 55 is described below if a power noise generated due to disturbance, such as the falling of a thunderbolt, is introduced through the wire 40, or the percussion unit 30, or the input terminal or output terminal of the surge protection circuit unit 55 of the discharge adaptor 50.

If the introduced power noise is a positive polarity power noise inputted to any one of the (+) output terminal and (+) input terminal of the surge protection circuit unit 55, the positive polarity power noise is discharged to the ground through the first diode and the second SPD. Furthermore, if the positive polarity power noise is a specific range or more and becomes a TVS operating voltage or higher, the positive polarity power noise is connected to the first SPD through the TVS and discharged to the earth. Furthermore, if the positive polarity power noise is a GDT operating voltage or higher, the GDT also operates, and thus the positive polarity power noise is discharged to the earth. As a result, the claymore mine does not operate.

Furthermore, if the introduced power noise is a negative polarity power noise inputted to any one of the (+) output terminal and (+) input terminal of the surge protection circuit unit 55, the introduced negative polarity power noise is discharged to the ground through the second diode and the first SPD. Furthermore, if the negative polarity power noise is a specific range or more and thus is a TVS operating voltage or higher, the negative polarity power noise is connected to the second SPD through the TVS and then discharged to the earth. Furthermore, if the negative polarity power noise is a GDT operating voltage or higher, the GDT also operates, and thus the negative polarity power noise is discharged to the earth. As a result, the claymore mine does not operate.

If the introduced power noise is a positive polarity or negative polarity power noise inputted to any one of the (−) output terminal and (−) input terminal of the surge protection circuit unit 55, only the third or fourth diode conducts and other discharging operation of the circuit is the same compared to the case where the introduced power noise is inputted to the (+) output terminal or (+) input terminal of the surge protection circuit unit 55, and thus a detailed description is omitted.

As described above, the claymore mine on which a device for preventing a breakdown attributable to a power noise has been mounted in accordance with an embodiment of the present invention can prevent the breakdown of the claymore mine by fundamentally blocking a power noise introduced into the wire 40 and the discharge adaptor 50. Furthermore, the breakdown of the claymore mine can be prevented because an introduced power noise is discharged to the earth through the discharge adaptor 50 although the power noise is introduced.

Furthermore, if the claymore mine does not normally operate due to the abnormality of the discharge adaptor 50 added to an existing claymore mine, the percussion unit 30 and the wire 40 can be coupled and separated after the discharge adaptor 50 can be rapidly removed because percussion unit 30 and the wire 40 are coupled using the outlet-plug coupling method. Accordingly, a structurally safe claymore mine capable of preparing the abnormality of the discharge adaptor 50 can be provided.

An embodiment of the present invention relates to a claymore mine on which a device for preventing a breakdown attributable to the falling of a thunderbolt has been mounted, and is used to prevent the breakdown of a claymore mine attributable to a power noise that is generated due to a mutual induction action between the falling of a thunderbolt, an earth fault current, an electromagnetic pulse (EMP), a nuclear electromagnetic pulse (NEMP), a high altitude nuclear electromagnetic pulse (HEMP), or magnetic fields, electromagnetic waves, or other electromagnetic wave noises and a wire that connects the percussion unit and the electric primer and percussion unit of the claymore mine.

What is claimed is:

1. A claymore mine on which a device for preventing a breakdown attributable to a power noise has been mounted, the claymore mine comprising:

an explosion unit;

an electric primer;

a wire;

a percussion unit, wherein the wire connects to the percussion unit and the electric primer, the wire being shielded by conductive materials; and a surge protection circuit unit comprising:

an output terminal of the percussion unit electrically connected to a (+) input terminal and (−) input terminal of the surge protection circuit unit through a percussion unit outlet and discharge adaptor plugs, the (+) input terminal is connected to an anode of a first diode and a cathode of a second diode, connected to a terminal Bo of a GDT, and electrically connected to a first conductor of the wire through a (+) output terminal of the surge protection circuit unit, an anode of the second diode connected to a terminal PD of a TVS and an anode of a fourth diode and connected to a discharge adaptor shield connected to a ground line through a first SPD, a cathode of the first diode connected to a terminal P of the TVS and a cathode of a third diode and connected to the discharge adaptor shield connected to the ground line through a second SPD, another terminal of output terminals of the percussion unit connected to an anode of the third diode and a cathode of the fourth diode and connected to a terminal F4 of a GDT and electrically connected to a second conductor of the wire through an (−) output terminal of the surge protection circuit unit, and a terminal PE of the GDT connected to a discharge adaptor shield unit.

2. The claymore mine of claim 1, wherein the surge protection circuit unit is electrically connected between the wire and the percussion unit.

3. The claymore mine of claim 1, wherein the conductive materials comprise a carbon fiber.

4. The claymore mine of claim 2, wherein the surge protection circuit unit comprises a discharge adaptor shielded by conductive materials.

5. The claymore mine of claim 4, further comprising a discharge adaptor connected between the wire and the percussion unit using an outlet-plug method.

6. The claymore mine of claim 5, wherein the discharge adaptor is additionally coupled between the electric primer and the wire.

* * * * *